United States Patent [19]

Trefzger

[11] Patent Number: 4,905,906

[45] Date of Patent: Mar. 6, 1990

[54] CONTINUOUS SPRAYER

[75] Inventor: Edwin W. Trefzger, Ilion, N.Y.

[73] Assignee: D. B. Smith and Company, Inc., Utica, N.Y.

[21] Appl. No.: 317,574

[22] Filed: Mar. 1, 1989

[51] Int. Cl.[4] ..... B05B 9/03

[52] U.S. Cl. ..... 239/333; 222/321; 222/341; 222/381

[58] Field of Search ..... 239/329, 331, 333; 222/321, 325, 341, 381, 382

[56] References Cited

U.S. PATENT DOCUMENTS

| | | | |
|---|---|---|---|
| 1,137,551 | 4/1915 | Taby et al. . | |
| 1,524,159 | 1/1925 | Sunderman . | |
| 2,106,620 | 1/1938 | Nilson . | |
| 2,231,059 | 2/1941 | Douglass et al. . | |
| 2,540,290 | 2/1951 | Rappl et al. . | |
| 2,567,496 | 9/1951 | Pittenger | 222/321 X |
| 4,109,832 | 8/1978 | Kutik et al. | 222/321 X |
| 4,146,155 | 3/1979 | Kutik et al. | 222/331 X |
| 4,591,077 | 5/1986 | Corsette | 222/321 |
| 4,826,052 | 5/1989 | Micallef | 222/321 |

*Primary Examiner*—Andres Kashnikow
*Assistant Examiner*—William Grant
*Attorney, Agent, or Firm*—Wall and Roehrig

[57] ABSTRACT

A continuous sprayer has a trigger-actuated piston assembly within a cylinder. The trigger urges the piston assembly distally in the cylinder and a coil spring urges it proximally against action of the trigger. The piston assembly has a plunger portion and a hollow piston rod that extends out through a sliding seal in the cylinder distal end and on which is mounted a spray nozzle. The hollow piston rod contains a shutoff rod that cooperates with a standard spring bias ball valve contained in the plunger. At the distal end of the shutoff rod there is a seal to cause complete shutoff as the rod is urged against a compression spring and mates with a seat in the nut of the nozzle. A shutoff pin at the proximal end of the cylinder contacts the shutoff rod when the trigger is completely released and the piston assembly travels to its extreme proximal position. When the handle is fully released, the plunger is forced back by the coil spring, causing the shutoff pin to come in contact with the shutoff rod, to urge the shutoff rod forward and cause the seal to mate with the nozzle nut. Shutoff is effected upon full release of the spray trigger, but partially depressing the trigger will permit the pressurized liquid within the cylinder to spray continuously out the nozzle.

8 Claims, 3 Drawing Sheets

CONTINUOUS SPRAYER

BACKGROUND OF THE INVENTION

The present invention is directed to sprayers and spraying devices, especially sprayers for use in the garden or around the home. The invention is directed towards sprayers for applying water or aqueous material, such as fertilizer, pesticides, and the like. The present invention is more especially directed to continuous sprayers in which a pressurized liquid is discharged through a nozzle by hand actuation of a trigger or lever.

Continuous sprayers that are presently available generally require a pressurized tank, in which, prior to a spraying operation, the tank must be charged by a hand pump. These sprayers are usually heavy and rather cumbersome to use, as well as being rather expensive. Small, self-contained, hand-held sprayers generally do not provide continuous action, but only provide intermittent spraying. That is, the small sprayers can spray when the handle or trigger is squeezed, but not otherwise. Moreover, no one has previously proposed a satisfactory hand-held sprayer with separate tank, as the problem of providing both pressurization and shut-off within the same hand-held sprayer device has eluded the industry.

OBJECTS AND SUMMARY OF THE INVENTION

Accordingly, it is an object of this invention to provide a continuous sprayer which avoids the drawbacks of the prior art.

It is a more particular object of this invention to provide a hand-held sprayer, with a trigger or actuating lever which can be operated intermittently and yet deliver a continuous spray.

It is another object of this invention to provide a continuous sprayer of this type in which a simple release of the trigger stops the spray.

It is yet another object of this invention to provide a continuous sprayer having a separate tank which is not pressurized in operation, and which can also serve for safe storage of chemicals.

It is still another object of this invention to provide a continuous sprayer which produces enough pressure to spray a stream of liquid sufficient to reach the tops of fruit trees or similar vegetation.

It is a still further object of this invention to provide a continuous sprayer of this type which has sufficient flexibility that it can be employed either to spray single plants or to spray an entire yard or garden.

It is yet another object of this invention to provide a continuous sprayer to which an extension wand can attach at its nozzle for spraying hard to reach areas and for avoiding operator back fatigue.

It is a yet further object of this invention to provide a continuous sprayer which avoids the need for pressuring its tank, thus providing carefree one-handed operation.

It is a yet further object of this invention to provide a continuous sprayer that can be inexpensively molded of available and lightweight polymers.

In accordance with an aspect of this invention, a continuous-flow sprayer system has a pistol-type hand-held spraying device, connected by a conduit or hose to an unpressurized supply tank which can be carried with a suitable shoulder strap. The sprayer device is formed of a housing having a handle and a cylinder within the housing. The supply hose or conduit is coupled to a proximal end of the cylinder to supply to it the liquid to be sprayed. A suitable check valve is included here to permit flow of the liquid only from the conduit into the cylinder. A piston assembly travels proximally-distally within the cylinder, and includes a plunger that contacts the inner wall of the cylinder, a hollow tubular piston rod that extends distally out from the plunger and passes distally out of the cylinder through a sliding seal at the distal end of the cylinder, a one-way valve in the plunger for admitting fluid flow in the distal direction into the hollow piston rod, and an opening in the hollow piston rod to permit fluid communication between the rod interior and an annular chamber defined by the portion of the cylinder that is distal of the plunger. A spray nozzle is situated at the end of the hollow piston rod that is distal of the cylinder.

A squeeze trigger is rockably mounted on the housing adjacent the handle. A suitable linkage urges the piston assembly distally when the trigger is squeezed. A compression coil spring or other suitable resilient member urges the piston proximally when the trigger is released.

A shut-off rod assembly, or other suitable shut-off means, is situated inside the hollow piston rod and serves to block flow of the liquid through the hollow piston rod and out of the nozzle when the trigger is completely released. However, when the trigger is squeezed, even partially, the shut-off rod assembly opens to permit spraying out through the nozzle.

The shut-off rod assembly has a rod that carries a sealing member at its distal end for meeting with a seat formed at a portion of the piston rod or a portion of the nozzle assembly, with a coil spring that biases the shut-off rod in the proximal direction so that the rod is normally urged to break the seal away from the seat. At the proximal end of the main cylinder there is a shut-off post or pin which contacts the proximal end of the shut-off rod to push it distally and push the seal against the seat when the piston assembly is moved to its extreme proximal position, i.e., when the trigger is completely released. Preferably, a one-way ball type check valve is also formed at the proximal end of the shut-off rod to seat at an opening into the tubular piston rod through the piston plunger.

The above and many other objects, features, and advantages of this invention will be more fully understood from the ensuing description of a preferred embodiment, which should be read in connection with the accompanying drawing.

DETAILED DESCRIPTION OF THE PREFERRED EMBODIMENTS

Figure 1:
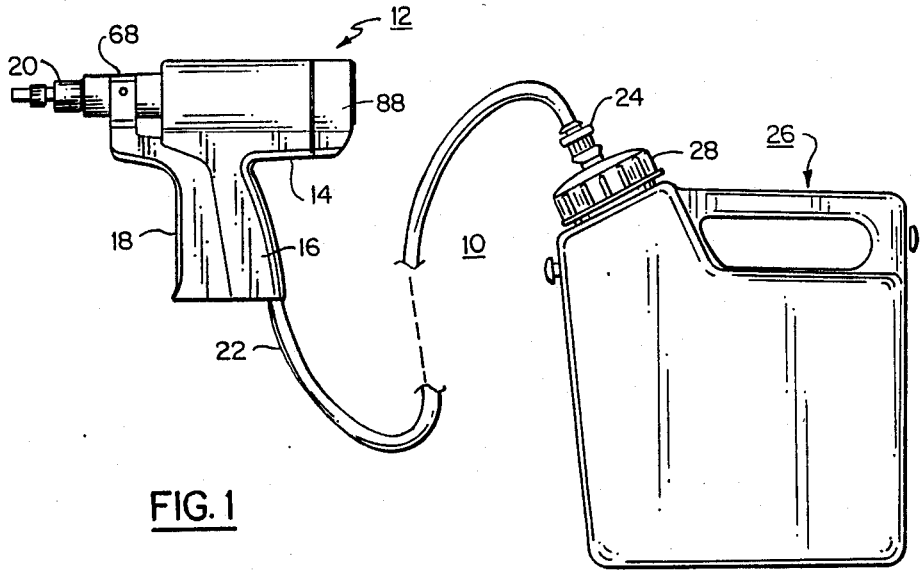
FIG. 1 is a perspective view of a continuous sprayer system according to one preferred embodiment of this invention.
Figure 5:
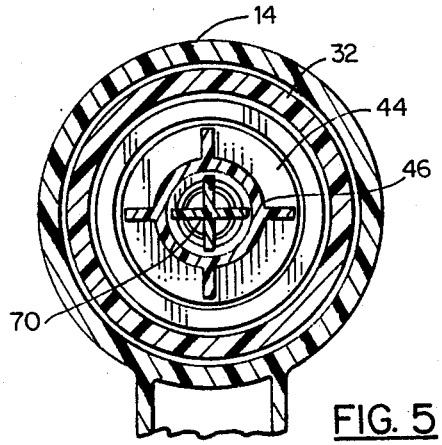
FIGS. 4, 5, 6 and 7 are cross sectional views taken at lines 4—4, 5—5, 6—6, and 7—7 of FIG. 3.
Figure 4:
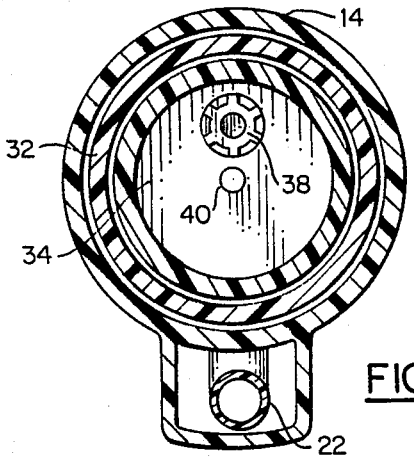
Figure 6:
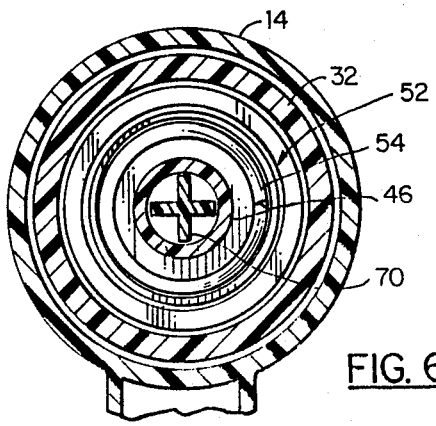
Figure 7:
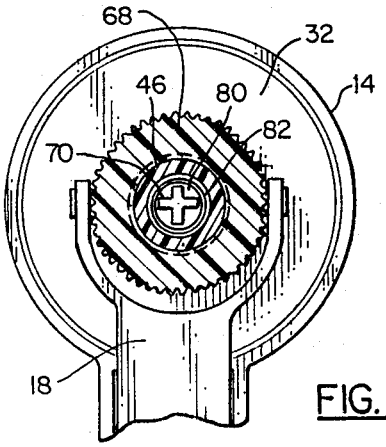

With reference to the Drawing, and initially to FIG. 1, a continuous spray gun assembly 10 comprises a spray gun unit 12 that has a housing 14 with a handle 16 and a squeeze trigger 18 rockably mounted adjacent the handle 16. A nozzle assembly 20 is mounted on the unit 12 at its distal end, which is to the left in the drawing figures. A hose or conduit 22 extends from the spray gun unit 12 to a female connector 24 which attaches to a tank-type container 26 at a fill cap 28 thereof.

Figure 2:
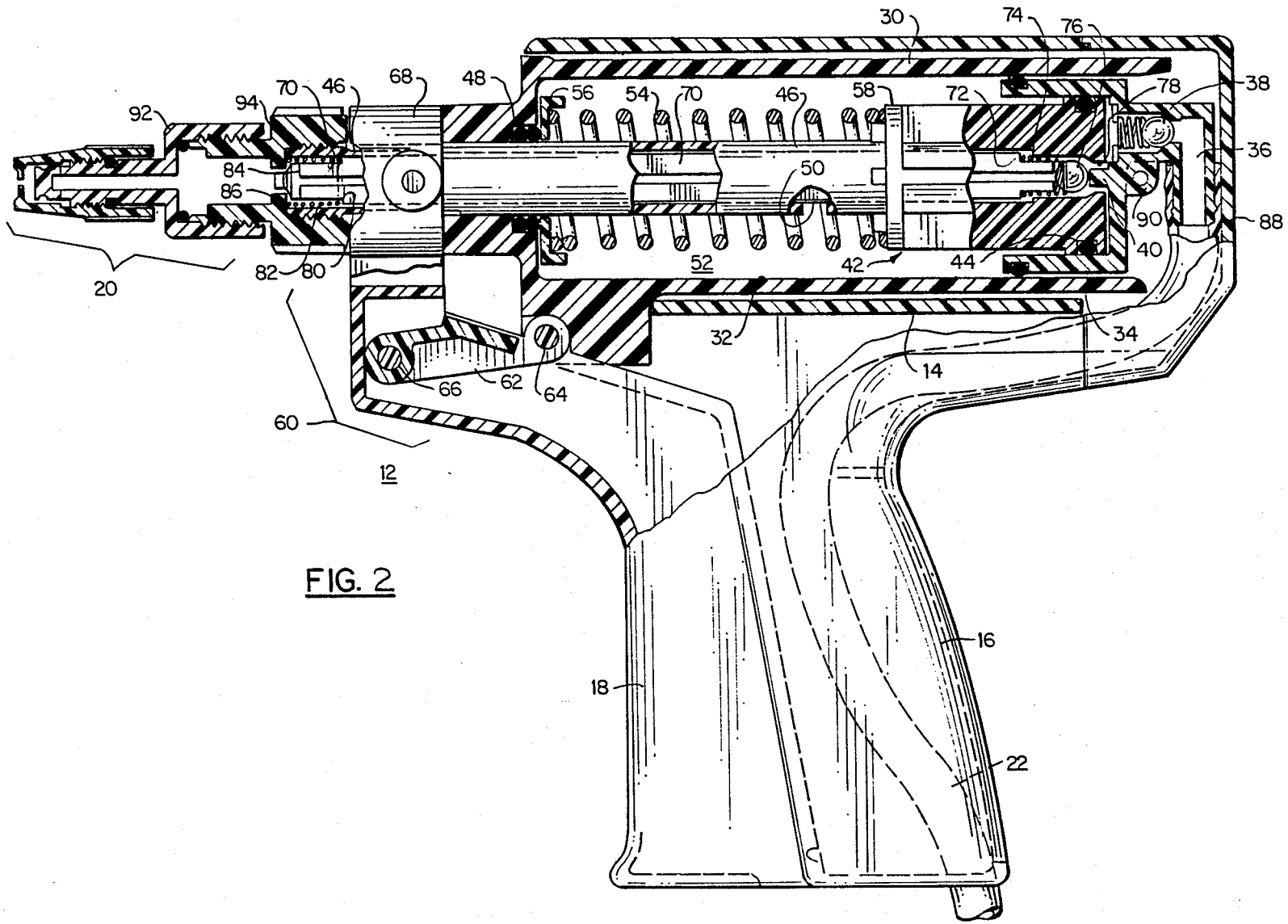
FIGS. 2 and 3 are sectional side elevations of the sprayer device of this preferred embodiment showing the trigger released and depressed respectively.
Figure 3:
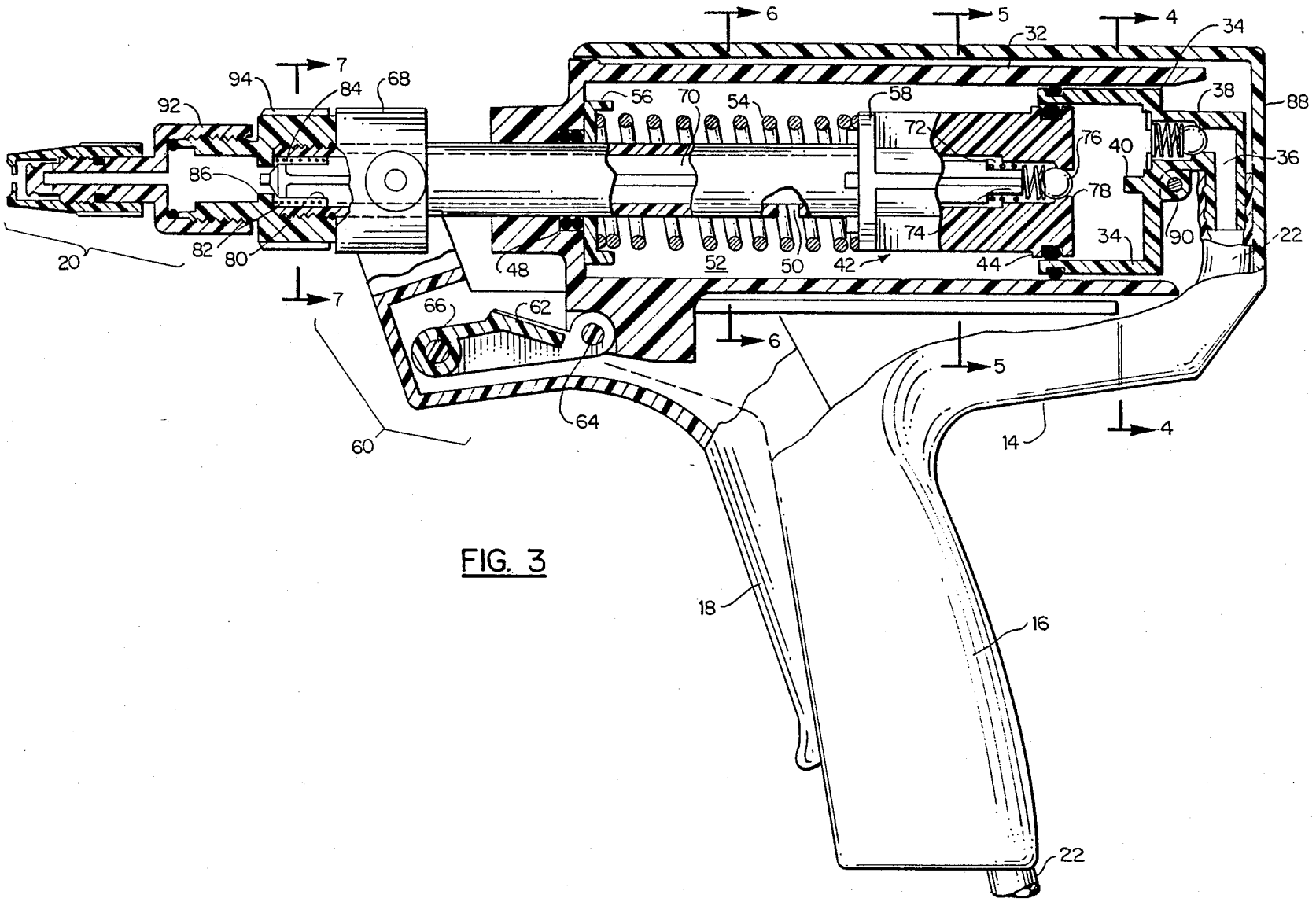

As shown in FIGS. 2 and 3, the spray gun unit 12 has a cylinder assembly 30 situated within the housing 14, and which is formed of a main forward or distal portion 32 and a proximal cylinder cap 34 that is inserted into an open proximal end of the portion 32 and is locked in place therein with a pin (not shown). As is apparent, the end cap 34 has a cylindrical sleeve that sealably mates against the cylindrical wall of the main cylinder portion 32, and also has a proximal end wall from which a hose barb 36 extends. The hose 22 enters the spray gun unit 22 through the handle 14 and connects to this hose barb 36. A ball-type check valve 38 is situated within the barb 36 to permit flow only in the direction from the tank 26 and hose 22 into the cylinder 30.

Mounted axially on the center of the distal side of the end wall of the cylinder cap 34 is a shutoff pin 40 that extends distally for a short distance. The purpose of the shutoff pin 40 will be discussed below.

Within the cylinder 30 is a piston assembly 42 that comprises a piston plunger 44 and a tubular hollow piston rod 46. The plunger extends radially outward to contact the inner wall of the cylindrical sleeve of the end cap 34. As shown here, in the preferred embodiment, O-ring sealing member is employed to seal between the plunger 44 and the cylinder cap 34, although many other suitable sealing structures are known, and could be employed instead. The piston rod 46 extends distally out the forward end of the cylinder 30 through a sliding seal assembly 48 at the distal end of the cylinder forward portion 32. In addition to the opening at the forward end of the tube piston rod 46, there is a single opening 50 positioned on the under side and about midway between the proximal and distal end of the cylinder 30 and communicating between the inside of the tubular piston rod 46 and an annular cavity or chamber 52 within the cylinder 30 and on the distal side of the plunger 44. In this embodiment, the opening 50 defines a unique fluid passageway into or out of the chamber 52. This chamber 52 serves as a reservoir or accumulator for the fluid, and is primed by squeezing the handle 16 and trigger 18 a few times at the commencement of a spraying operation.

A coil compression spring 54 within the chamber 52 is disposed between a retainer cup 56, that is situated against the distal wall of the cylinder 30, and a shoulder portion 58 that is formed on the piston rod 46. This compression spring 54 has a comparatively high spring constant, and pushes the piston assembly 42 proximally against the squeezing action of the trigger 18, i.e., towards the position shown in FIG. 2.

A trigger assembly 60 is formed of the squeeze trigger 18 and a link 62. The link 62 is joined by a first pivot pin 64 to a protuberance at the forward or proximal side of the cylinder 30, and by a second pivot pin 66 to the squeeze trigger 18. A ring 68 is pivotally mounted onto the trigger 18 above the link 62, and this ring 68 fits over a portion of the piston rod 46 that projects distally out from the cylinder 30. The nozzle assembly 20 screws onto a thread on the distal end of the piston rod 46 and provides a bearing surface for the ring 68. Thus, when the handle 18 is squeezed, as shown in FIG. 3, the nozzle and also the entire piston assembly 42 are urged forward, i.e., in the distal direction, or leftwards in these views.

A shutoff rod 70, here formed as an X-beam member, is disposed within the hollow tubular piston rod 46. At a proximal end of the rod 70 there is formed a shoulder 72 on which is mounted a spring 74 for urging a ball 76 against a seat 78 formed in the plunger 44 at an orifice that opens out to the proximal side of the plunger 44. The spring 74, ball 76, and seat 78 form a ball-type check valve which admits liquid from the portion of the cylinder proximally of the plunger into the hollow piston rod 46.

At the distal end of the shutoff rod 70 there is a shoulder 80 on which is disposed a coil spring 82, a sealing plate or disk 84 is also formed at the distal end of the rod 70, and can carry an O-ring or other sealing member. Annular seat 86 is formed in the nozzle 20 and this is directed radially inwards to form a seat for the spring 82 and for the seal on sealing plate 84. The spring constant for the distal-end spring 82 is greater than that of the proximal end spring 74, so that normally, as shown in FIG. 3, when the handle 16 and trigger 18 are being squeezed, the spring 82 urges the rod 70 proximally. This holds the sealing plate 84 away from the seat 86, thereby permitting spraying out the nozzle. However, when the trigger 18 is completely released, as shown in FIG. 1, the piston assembly 42 is situated at an extreme proximal position, so that the cutoff pin 40 presses against the ball 76 and shutoff rod 70. This presses the sealing plate 84 against the seat 86.

As is also shown, a housing cap 88 closes off the proximal end of the housing 14, i.e., over the hose 22 and hose barb 36. Further, an opening 90 through a protuberance at the proximal side of the cylinder cap 34 receives a retaining pin which is pushed through similar openings (not shown) in the proximal end of the cylinder portion 32 to lock the latter to the cylinder cap 34.

In operation, when the trigger 18 is squeezed and released, the piston assembly travels back and forth in the cylinder 30 between the positions shown in FIGS. 2 and 3 creating a suction which opens check valve 38. This brings fluid in from the tank through the hose 22 and check valve 38 into the cylinder 30, and then through the plunger 44 by means of the ball-type check valve 74, 76, 78, into the open interior of the hollow piston rod 46. The liquid then flows through the opening 50 into the chamber 52 within the cylinder 30 until it is sufficiently filled with liquid at adequate pressure to provide continuous spraying. Thereafter, the trigger is squeezed fully only on an intermittent basis to restore pressure. The shutoff rod 70 will stop all flow out through the nozzle assembly 20 as long as the trigger 18 is fully released. However, applying a gentle pressure on the trigger 18 will bring the piston assembly 42 a short distance forward off the shutoff pin 40, and the liquid will be sprayed out the nozzle assembly 20.

While not shown here, an extension accessory wand can be attached between a nozzle portion 92 and a nozzle mount nut portion 94, of the nozzle assembly 20. Except for the springs, pivot pins, and other minor hardware, the spray gun unit 12 can be molded of suitable synthetic resin materials which are inexpensive, and also resistant to the liquids to be sprayed. The entire system is light weight, and can be conveniently carried to permit one-hand operation.

A number of O-rings are represented in the drawing figures as conventional sealing members. However, it should be understood that other well-known sealing arrangements could be employed, especially where the piston, cylinder, and other parts are molded of a plastic synthetic resin.

While this invention has been described in detail with respect to a single preferred embodiment, it should be evident that the invention is not limited to that precise embodiment. Rather, many modifications and variations would present themselves to those of skill in the art, without departing from the scope and spirit of this invention, as defined in the appended claims.

What is claimed is:

1. A continuous flow sprayer device with positive cutoff, comprising a housing having a handle; a cylinder within said housing; a supply conduit for carrying to said cylinder at a proximal end thereof a liquid to be sprayed and including check valve means permitting flow of said liquid only from said conduit into said cylinder; a piston assembly which travels proximally-distally in said cylinder and including a plunger which contacts the wall of said cylinder, a hollow tubular piston rod that extends distally from said plunger and passes distally out of said cylinder through a sliding seal in a distal end thereof, a one-way valve in said plunger admitting fluid flow only in the distal direction into said hollow piston rod, and an opening in said hollow piston rod to permit fluid communication between said rod and an annular chamber defined by the portion of said cylinder distal of said plunger; a spray nozzle on said hollow piston rod distal of said cylinder; a squeeze trigger adjacent said handle and rockably mounted with respect to said housing including linkage means for urging said piston assembly distally when said trigger is squeezed; resilient means for urging said piston assembly proximally when said trigger is released; and shutoff means to block flow of said liquid through said hollow piston rod and out of said nozzle when said trigger is completely released, but which permits flow out through said nozzle when said trigger is at least partially squeezed.

2. A continuous flow sprayer device according to claim 1, wherein said opening in said hollow piston rod is disposed about midway from said plunger to the distal end of said cylinder, and at a downward facing side of said piston rod.

3. A continuous flow sprayer device according to claim 2, wherein said opening defines a unique passageway.

4. A continuous flow sprayer device according to claim 1, wherein said shutoff means includes a shutoff rod disposed within said hollow piston rod, a seal carried on said shutoff rod at a distal end thereof for mating with a seat formed at a portion of said piston rod in advance of said opening to shutoff flow through the piston rod, resilient means biasing said shutoff rod proximally to urge said seal away from said seat, and means carried on said cylinder to urge said shutoff rod distally to overcome the resilient means and bias the seal against said seat when said piston assembly moves to an extreme proximal position.

5. A continuous flow sprayer device according to claim 4 wherein said one-way valve comprises a ball check valve in which a seal is formed at a proximal opening in said plunger, a spring is mounted at a proximal end of said shutoff rod and yieldably urges a ball against said seal, and said means carried on said cylinder to urge the shutoff rod distally includes a pin axially aligned with said ball check valve to contact said ball and urge said ball and shutoff rod distally with respect to said piston rod when said plunger moves to said extreme proximal position.

6. A continuous flow sprayer device according to claim 5 in which said resilient means for said shutoff means includes a spring having a higher spring constant than the spring of the ball check valve.

7. A continuous flow sprayer device according to claim 1 in which said resilient means for urging said piston proximally includes a coil spring which is disposed in said cylinder in the annular chamber thereof distal of said plunger.

8. A continuous flow sprayer device according to claim 1 in which said cylinder has a main cylinder portion having a distal end wall and a cylindrical wall, and a cylinder cap having a proximal wall and a cylindrical sleeve which fits within said main cylinder portion, said piston assembly plunger contacting an inner surface of the cylindrical sleeve of said cylinder cap.

* * * * *